United States Patent [19]

Hong et al.

[11] Patent Number: 4,995,174

[45] Date of Patent: Feb. 26, 1991

[54] SHOE WITH DETACHABLE TOE COVER

[76] Inventors: Ming-Che Hong, No. 5, Lane 76, Sec. 2, Shan Hsi Rd., Pei Chu, Taichung; Ching K. Wu, No. 1-4, Alley 174, Lane 77, Sec. 1, An Ho Rd., Tainan; Martin Lee, Room 704, No. 592, Lin Sen N. Rd., Taipei, all of Taiwan

[21] Appl. No.: 512,740

[22] Filed: Apr. 20, 1990

[51] Int. Cl.[5] ..... A43C 13/14

[52] U.S. Cl. ..... 36/72 R; 36/77 R

[58] Field of Search ..... 36/72 R, 72 B, 77 R

[56] References Cited

U.S. PATENT DOCUMENTS

| | | | |
|---|---|---|---|
| 1,245,763 | 11/1917 | Pass | 36/72 R |
| 2,076,514 | 4/1937 | Huffman | 36/72 B |
| 2,111,536 | 3/1938 | Murray | 36/72 R |
| 2,615,261 | 10/1952 | Grotto | 36/72 R |
| 3,037,304 | 6/1962 | Duffy | 36/72 R |
| 3,175,311 | 3/1965 | MacQuaid | 36/72 R |
| 3,206,874 | 9/1965 | Ellis et al. | 36/72 R |
| 3,593,438 | 7/1971 | Mitchell | 36/77 R |
| 4,051,612 | 10/1977 | Damron | 36/72 R |
| 4,177,583 | 12/1979 | Chapman | 36/72 R |

FOREIGN PATENT DOCUMENTS

| | | | |
|---|---|---|---|
| 1098580 | 8/1955 | France | 36/72 R |

*Primary Examiner*—Steven N. Meyers

*Attorney, Agent, or Firm*—Zarley, McKee, Thomte, Voorhees & Sease

[57] ABSTRACT

A shoe with a placement track on the front perimeter of its sole which slidably receives a toe cover in it. The toe cover includes a sheath or covering portion and a rim portion. The rim portion has apertures at its ends in order to receive and engage with securement wedges at the ends of said placement track.

3 Claims, 4 Drawing Sheets

SHOE WITH DETACHABLE TOE COVER

BACKGROUND OF THE INVENTION

The present invention relates generally to shoes with reinforced toe portions, and in particular relates to a shoe in which the reinforced toe portion is detachable from the shoe.

In the past, many different types of safety shoes and shoes with reinforced toe portions have been available. Nevertheless, these safety shoes were generally construction-type leather shoes or boots. The most common type of these was the construction boot with steel-reinforced toe. Obviously, these boots were rugged and effective for toe protection. On the other hand, the steel-reinforced boot was heavy (due to the steel reinforcement as well as the leather construction thereof) and not meant for all-around usage, but rather for rugged uses only. Therefore, it would be desirable to provide an all-around shoe which can be used as a safety shoe and which can also be used as an everyday shoe.

SUMMARY OF THE INVENTION

It is a primary objective of the present invention to provide a shoe which has a detachable toe cover at the front end thereof.

It is another objective of the present invention to provide such a detachable shoe cover which is durable and inexpensive.

It is still another objective of the present inveniton to provide a number of shoe covers as described above, which have an assortment of colors or patterns thereon, for interchangeability by the user as desired for esthetic purposes.

Further objectives and advantages of the present invention will become apparent as the following description proceeds, and the features of novelty which characterize the invention will be pointed out with particularity in the claims annexed to and forming a part of this invention.

These and additional objects, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENT

The shoe with detachable toe cover in accordance with the present invention will now be discussed in detail.

Figure 1:
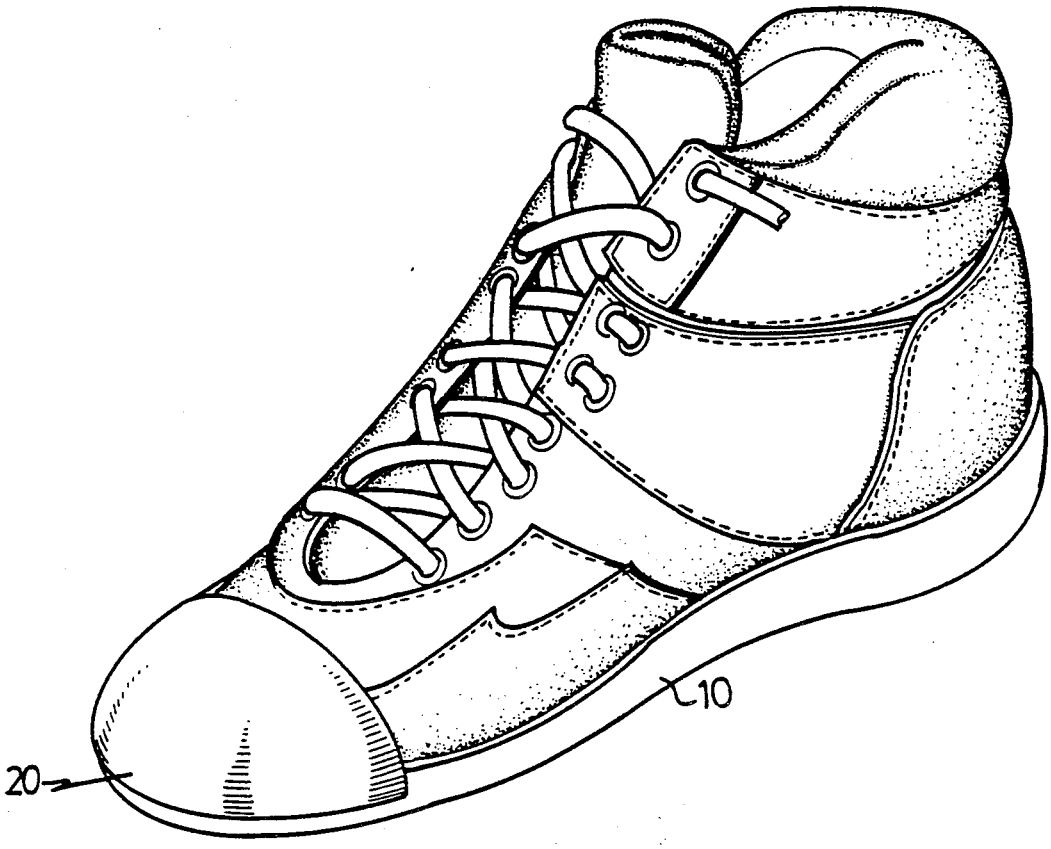
FIG. 1 is a perspective view of a shoe with detachable toe cover in accordance with the present invention.
Figure 2:
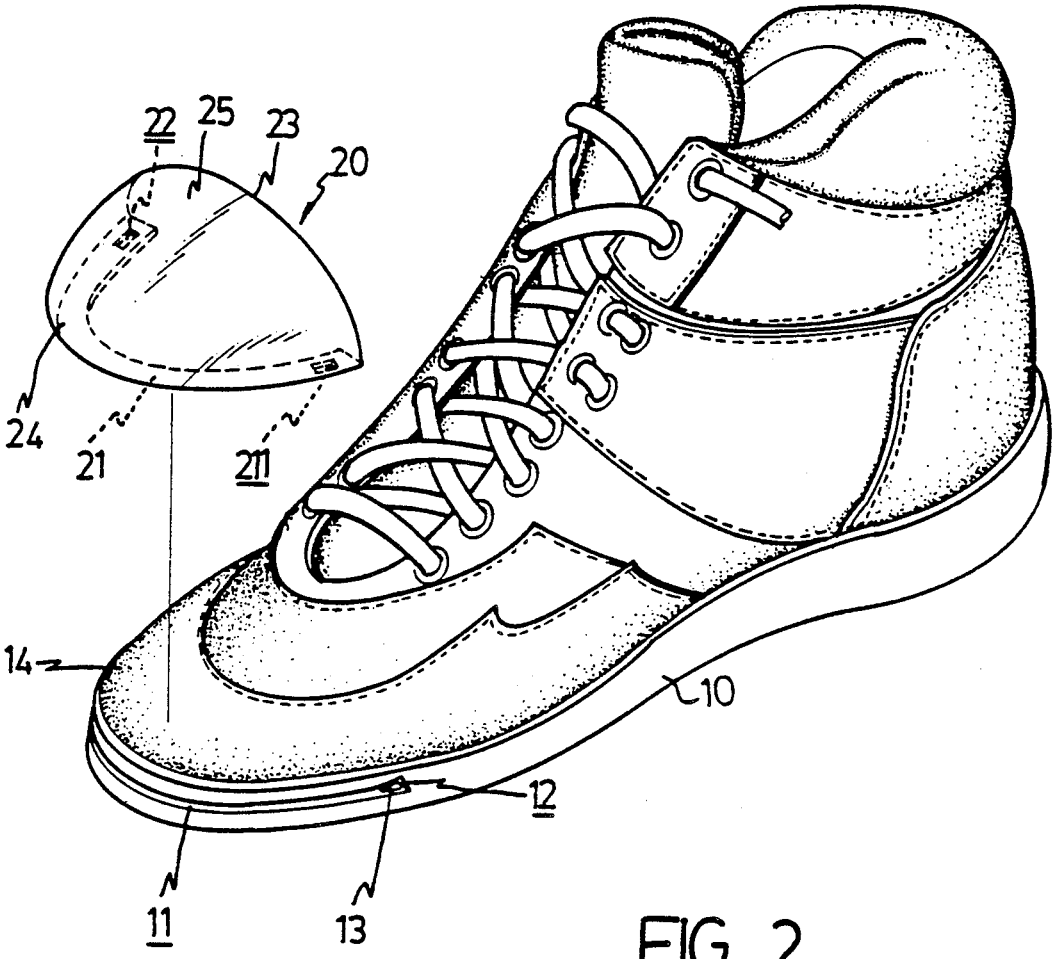
FIG. 2 is an exploded view of the shoe of FIG. 1.
Figure 3:
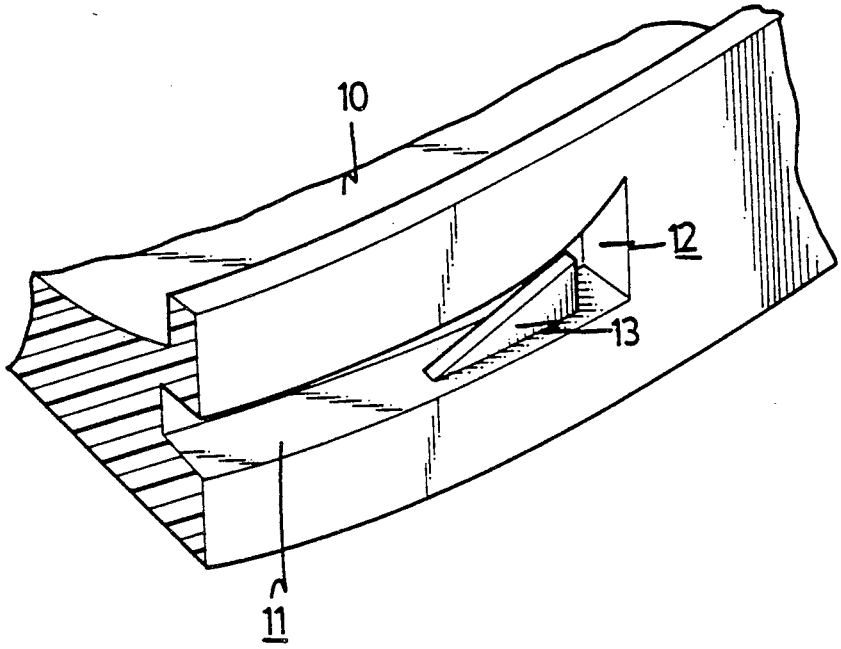
FIG. 3 is a close-up cutaway view of the sole of the shoe of FIG. 1, showing the placement track and engagement cavity thereof more clearly.

As best seen from FIGS. 1 and 2, the shoe with detachable toe cover of the present invention includes the combination of a toe cover 20 and a sole 10 with a placement track 11 in it.

The toe cover 20 comprises a sheath portion 25 at its upper end and a rim portion 21 at its lower end. These portions, 25 and 21, are integral with each other and made of the same material, which could be some type of metal, metal alloy, or semi-rigid plastic. The sheath portion 25 has two ends, namely a rounded front end 24 and an open rear end 23. The rim portion 21 is flat and substantially U-shaped, with an apertures 22 proximate to each distal end thereof.

Referring to FIGS. 2–6, it can be understood that the sole 10 has a placement track 11 at its front perimeter which slidably receives the rim portion 21. Each of the distal ends of the placement track 11 terminates in a respective engagement cavity 12 which is substantially triangular in shape. The engagement cavities 12 each have a securement wedge 13 therein which protrudes from a lower surface of the placement track 11. These securement wedges 13 engage with the rim portion 21 at the aperture 22 thereof when the detachable toe cover 20 is slid to the distal ends of the placement track 11.

Figure 4:
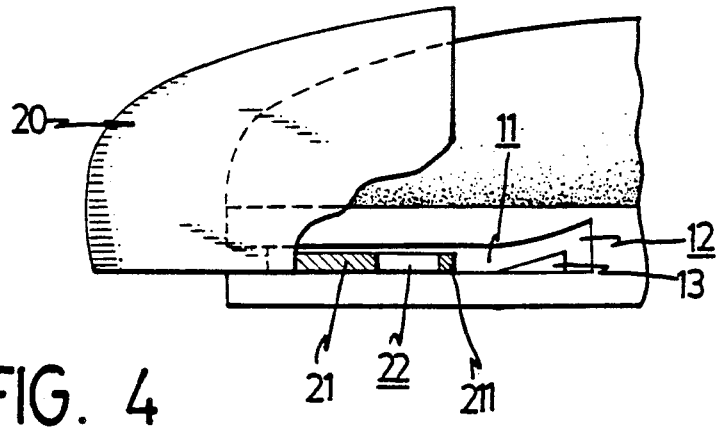
FIG. 4–6 are cutaway elvational views of the front portion of the shoe of FIG. 1, with the engagement portion of the detachable toe cover being partially cut away for clarity.
Figure 5:
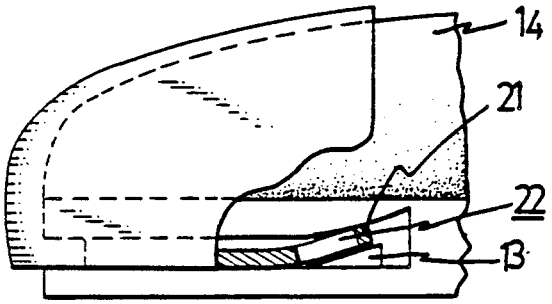
Figure 6:
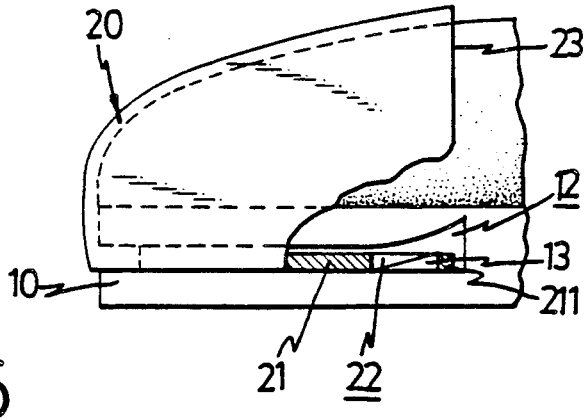

Referring to FIGS. 4–6, the order and method of the engagement of the detachable toe cover with the shoe will be explained. First, the rim portion 21 of the detachable toe cover 20 slides into the front part of the placement track 11, as seen in FIG. 4. As the user slides the detachable toe cover 20 closer to the engagement cavity 12 (FIG. 5), the engagement end 211 of the rim portion 21 is urged upwards along the securement wedge 13. Finally, referring to FIG. 6, it can be understood that as the engagement end 211 reaches the end of the securement wedge 13, it snaps down to allow the securement wedge 13 to be secured in the aperture 22 of the rim portion 21, thereby retaining the detachable toe cover until detached by the user. The engagement end 211 can snap back down due to the inherent flexibility in the material used to manufacture the detachable toe cover 20.

When the user desires to detach the toe cover 20, he simply lifts up on the open end 23 of the toe cover 20 and pulls away from the engagement cavity 12 of the placement track 11 until the toe cover 20 is completely detached therefrom.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as shall fall within the scope of the appended claims.

I claim:

1. A shoe with a detachable toe cover including the combination of:

(a) a toe cover (20) comprising a sheath portion (25) at an upper end thereof and a rim portion (21) at a lower end thereof which are integral with each other with, said sheath portion (25) having a rounded front end (24) and an open rear end (23), said rim portion (21) having respective apertures (22) proximate to distal ends thereof; and (b) a sole (10) with a placement track (11) at a front perimeter thereof for slidably receiving said rim portion (21), respective distal ends of said placement track (11) terminating in respective engagement cavities (12) which are substantially triangular in shape, said engagement cavities (12) having a securement wedge (13) which protrudes from a lower surface of said placement track (11) for engaging with said rim portion (21) at said aperture (22) thereof when said detachable toe cover (20) is slid to said distal ends of said placement track (11).

2. A shoe with detachable toe cover as set forth in claim 1 which is made of metal.

3. A shoe with detachable toe cover as set forth in claim 1 which is made of semi-rigid plastic.

* * * * *